US007586421B2

(12) United States Patent
Witte et al.

(10) Patent No.: US 7,586,421 B2
(45) Date of Patent: Sep. 8, 2009

(54) TRAFFIC SIGNAL DEVICES AND METHODS OF USING THE SAME

(75) Inventors: Edward Witte, Miami, FL (US); Glenn Wilkerson, Miami Beach, FL (US)

(73) Assignee: Emergency Traffic Systems, Inc., Miami, FL (US)

( * ) Notice: Subject to any disclaimer, the term of this patent is extended or adjusted under 35 U.S.C. 154(b) by 406 days.

(21) Appl. No.: 11/599,733

(22) Filed: Nov. 15, 2006

(65) Prior Publication Data

US 2007/0115139 A1 May 24, 2007

Related U.S. Application Data

(60) Provisional application No. 60/738,371, filed on Nov. 18, 2005.

(51) Int. Cl.
*G08G 1/95* (2006.01)

(52) U.S. Cl. ..... 340/908; 340/916; 340/924

(58) Field of Classification Search ..... 340/907–931
See application file for complete search history.

(56) References Cited

U.S. PATENT DOCUMENTS

| | | | | |
|---|---|---|---|---|
| 2,401,940 | A | 6/1946 | Lange | |
| 2,603,700 | A | 7/1952 | Martin | |
| 2,829,362 | A | 4/1958 | Terrill | |
| 2,941,185 | A | 6/1960 | Mullikin | |
| 3,046,521 | A | 7/1962 | Cantwell et al. | |
| 3,168,685 | A | 2/1965 | Beet | |
| 3,867,718 | A | 2/1975 | Moe | |
| 4,401,969 | A | 8/1983 | Green et al. | |
| 5,208,584 | A | 5/1993 | Kaye et al. | |
| 5,252,969 | A | 10/1993 | Kishi | |
| 5,400,019 | A | 3/1995 | Riscoe, Jr. | |
| 5,659,305 | A | 8/1997 | Rains et al. | |
| D388,726 | S | 1/1998 | Wu | |
| 5,805,081 | A | 9/1998 | Fikacek | |
| 5,900,826 | A | 5/1999 | Farber | |
| 5,986,576 | A | 11/1999 | Armstrong | |
| 6,054,932 | A | 4/2000 | Gartner et al. | |
| 6,064,318 | A * | 5/2000 | Kirchner et al. | 340/905 |
| 6,118,388 | A | 9/2000 | Morrison | |
| 6,147,623 | A * | 11/2000 | Rippen | 340/908 |
| 6,268,805 | B1 | 7/2001 | Simon | |
| D457,827 | S | 5/2002 | Williams et al. | |
| 6,392,563 | B1 | 5/2002 | Paquette et al. | |
| 6,496,123 | B2 | 12/2002 | Brinkman | |
| 6,522,263 | B2 | 2/2003 | Jones | |
| 6,940,422 | B1 * | 9/2005 | Bachelder et al. | 340/906 |
| 7,317,405 | B2 * | 1/2008 | Green et al. | 340/907 |
| 7,333,029 | B2 * | 2/2008 | Hammett | 340/908 |
| 2004/0070519 | A1 * | 4/2004 | Wu et al. | 340/907 |

* cited by examiner

*Primary Examiner*—Brent Swarthout
(74) *Attorney, Agent, or Firm*—Laurence A. Greenberg; Werner H. Stemer; Ralph E. Locher

(57) ABSTRACT

A traffic control system and device is provided. The traffic control system of the instant invention permits two-way communication between a plurality of traffic signal devices. Each traffic signal device locally controls the state of the traffic signals, while communication between the traffic signal devices is used to synchronize the internal timers or clocks of the plurality of traffic control devices.

37 Claims, 10 Drawing Sheets

TRAFFIC SIGNAL DEVICES AND METHODS OF USING THE SAME

PRIORITY

The present application claims priority from U.S. provisional patent application Ser. No. 60/738,371, Filed on Nov. 18, 2005 and entitled TEMPORARY TRAFFIC SIGNAL DEVICE.

BACKGROUND OF THE INVENTION

1. Field of the Invention

The invention relates to a traffic signal device and method and more particularly to a traffic signal device that can be erected at an intersection in anticipation of a loss of power or to supersede a permanent traffic signal in the event of a failure, and a method of using such a traffic signal device.

2. Description of the Related Art

Portable or backup traffic signal devices are known. See, for example, U.S. Pat. Nos. 2,401,940, 2,603,700, 2,941,185, 3,046,521, 3,867,718, 4,401,969, 5,208,584, 5,252,969, 5,400,019, 5,659,305, 5,900,826, 5,986,576, 6,118,388, 6,392,563, 6,496,123 and U.S. Design Pat. No. D457,827.

Certain of these devices portable or backup traffic signal devices can be remote controlled, such as is disclosed in U.S. Pat. No. 3,867,718 to Moe, U.S. Pat. No. 5,986,576 to Armstrong, and U.S. Pat. No. 6,118,388 to Morrison. Additionally, U.S. Pat. No. 6,392,563 discloses a traffic light backup system using light-emitting diodes and including a rechargeable battery associated with an auxiliary light, which is engaged in the event of a power failure.

Further, traffic lights including solar panels are disclosed in U.S. Pat. No. 6,268,805 to Simon and U.S. Pat. No. 6,522,263 to Jones.

U.S. Pat. No. 4,401,969 to Green et al., col. 1, lines 20-27, discloses that it is now known to provide traffic control systems consisting of a master control unit, and one or more slave units controlled by the master unit, in which the communication between the units in order to obtain a desired sequence of light signals is by means of radio wave transmissions from the master unit, and as examples may be mentioned those disclosed in U.S. Pat. Nos. 2,829,362 and 3,168,685. In Green, a portable traffic control system is disclosed in which receivers are controlled from a central transmitter and a carrier signal employed is modulated by two different modulation signals in order to command a green light to be shown. Further, in Green, the receipt of a carrier signal with only a single pilot modulation causes production of a red signal.

U.S. Pat. No. 5,805,081 to Fikacek discloses portable traffic signals including a control module. In one aspect of Fikacek, a remotely controlled power hoist is attached to the top of the control module for raising and lowering the traffic signal. Fikacek additionally discloses that, in place of manual controls, a transmitter can be mounted in the a module and used with receivers mounted in other traffic signals for synchronizing the traffic signal with the other traffic signals. Fikacek, which incorporates the disclosure of Green by reference, discloses modulated carrier signals are transmitted via an antenna to slave traffic signals, where they are processed to activate and de-activate the lights of the slaves.

U.S. Pat. No. 5,252,969 to Kishi discloses a temporary traffic signal system wherein a pair of signal stands are installed at spaced locations adjacent a traffic restricted area. Kishi discloses that the stands have an operation starting arrangement for initiating operation of the controllers of both of the stands at the same time, or a signal transmission arrangement for transmitting the operating condition data between the stands, so that the lights of both stands are operated in a controlled and synchronized relationship with each other. Col. 1 of Kishi, lines 36-40, disclose that it is an object of one aspect of that invention to provide a temporary signal system capable of operating both the parent and child signal stands by the transmission of setting and synchronizing data from the parent signal stand to the child signal stand to thereby conform actual time in a timer of the parent signal stand to that of the child signal stand for synchronizing the flashing operations between the parent and child signal stands.

However, what is needed is a traffic signal device and system that ensures the operability of the traffic signal devices in an intersection, and/or synchronicity of the timer or clock of each of the traffic signals, through bi-directional communication between the devices in the intersection. It would additionally be desirable for such traffic signal devices to be inexpensive, modular, portable and/or self-contained.

SUMMARY OF THE INVENTION

It is accordingly an object of the invention to provide a traffic signal device and method, which overcomes the above-mentioned disadvantages of the heretofore-known devices and methods of this general type.

A traffic control system and device is provided that permits two-way communication between a plurality of traffic signal devices. Each traffic signal device locally controls the state of the traffic signals, while communication between the traffic signal devices is used to synchronize the internal timers or clocks of the plurality of traffic control devices Other features which are considered as characteristic for the invention are set forth in the appended claims.

Although the invention is illustrated and described herein as embodied in a traffic signal device and method, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

The modular traffic signal device of the instant invention is designed to, preferably, be portable, inexpensive and easy to set-up. It is envisioned that, in cases of sudden emergency, such as power outage, hurricane, tornado, loss of a traffic signal device through accident, etc., it would be easy and cost effective to utilize one or more of the modular traffic signal devices in an intersection or railroad crossing until the permanent traffic signal devices can be restored to operation. Further, in a preferred embodiment of the instant invention, the modular traffic signal devices will include a plurality of preset programs that permit them to work individually or, as described more particularly in one particular preferred embodiment, together, for ease in setting up and of use.

Figure 1:
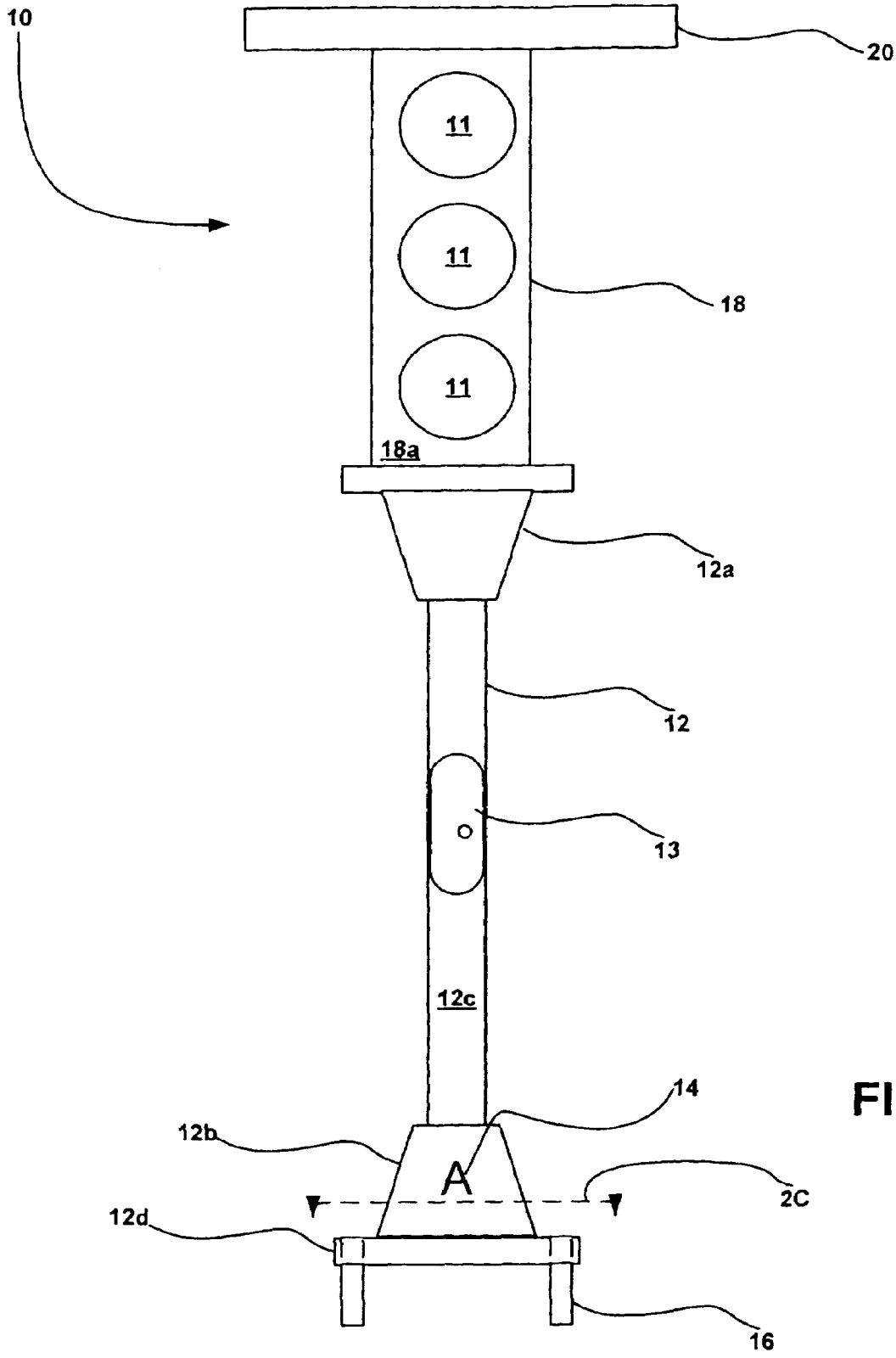
FIG. 1 is an illustration of a traffic signal device in accordance with one particular embodiment of the present invention.
Figure 2A:
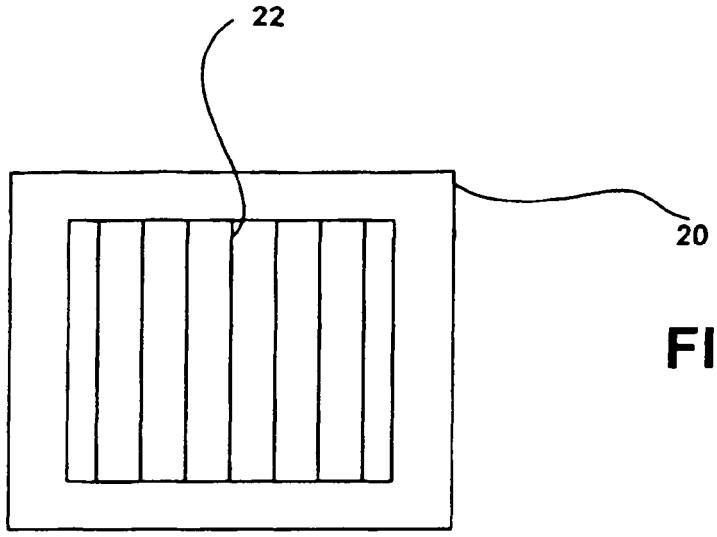
FIG. 2A is a top down perspective view of a solar charging system used with one particular embodiment of the present invention.

Referring now to the figures of the drawing in detail and first, particularly, to FIGS. 1 and 2 thereof, there is shown a modular traffic signal device 10 in accordance with one particular embodiment of the instant invention.

In the preferred embodiment of the invention shown in FIG. 1, the modular traffic signal device 10 includes a base 12. In order to reduce costs of production and of materials, the base 12 is preferably formed as a single piece of plastic in an injection molding process. The base 12 includes an upper support portion 12*a* that supports the signal device head 18, a base portion 12*b* including a flange 12*d*, and a trunk portion 12*c*, which separates the base portion 12*b* from the upper support 12*a*. Optionally, an opening is molded or cut into the trunk portion 12*c*, and a door 13 is moveably affixed thereto. In one particular embodiment, the base 12 is over 6 feet long. In a more preferred embodiment, the base 12 is 6 foot 10 inches in length.

Further, in one particular embodiment, an indicator, such as the indicator 14, can be molded into any location on the base 12, to assist in orienting the signal device 10 during placement in traffic. Although a letter is shown, it is to be understood that the indicator can be any identifying mark, such as a letter, number, symbol, or even a color, that will assist with the physical orientation of the signal device 10 during placement. A different indicator may be place on only the first side of the traffic signal device 10, or on two or more of the sides of the traffic signal device 10. Such indicator can be helpful to inform the person orienting the signal device 10 in the intersection which side is a first side. In this way, multiple traffic signal devices 10, each including multiple faces on the signal device head 18, can be oriented so as not to cause accidents (i.e., so that north-south facing signal device faces of multiple signal devices display a red light while east-west faces display a green light, and vice-versa). Alternatively, the controller of each signal device 10 can include a compass, which automatically detects the orientation of each face of a signal and arranges the program accordingly. The process of orienting the signal device 10 will be discussed more below.

A flange 12*d* on the base 12 is used to secure the traffic signal device to its chosen location. A top-down view of a preferred embodiment of a portion of the base portion 12*b* and flange 12*d*, taken at the cut 2C, is shown in FIG. 2C. In the present preferred embodiment, the base portion 12*b* is trapezoidal in shape, having a square or rectangular cross-section, such that each face of the base portion 12*b* can include an indicator 14 thereon, if desired. However, it is also contemplated in the instant invention that the base portion 12*b* can be frusto-conical in nature, having a circular cross-section.

Additionally, the flange portion may have holes therethrough that permit the use of broad-headed fasteners, such as screws 16, to pass through the flange 12*d* and secure the signal device 10 to the asphalt or concrete in a desired location. Fasteners 16 can be any appropriate type of fastener, such as a wood screw, asphalt or concrete screw, carriage bolt, etc. Additionally, if desired, holes for the fasteners 16 can be marked and pre-drilled in the asphalt or concrete, thus permitting the holes to be pre-filled with an epoxy resin, cement, or other material that will provide additional adherence of the signal device 10 to its chosen location.

From the foregoing, it can be seen that the base 12 can be adapted for installation in different ground conditions, such as snow, concrete, asphalt, dirt, rock, and uneven surfaces. Additionally, if desired, the base 12 can include a source of illumination for the intersection. For example, a light in the base 12 can be tied to a light-sensing device, such as a photo resistor, so that when it becomes dark, the light illuminates some portion of the intersection. In one preferred embodiment, the base 12 includes an emitter to emit a light beam, such as a laser beam, that marks the edge of the intersection, so that, even in the dark of a general power outage, drivers are informed of where to stop their cars outside of the intersection.

As stated above, the base 12 supports a signal device head 18, which, in one particular embodiment of the invention, is twenty inches in length. Alternatively, the signal device head 18 may be formed as an extension of the base 12, during the same injection molding process (or a further injection molding process) as formed the original base 12. As a further alternative, the signal device head 18 may be removeably connected to the base 12, such that the signal device head 18 can be removed and/or exchanged for maintenance, while the base 12 is still secured to its position in the intersection.

The signal device head 18 includes at least a single signal device face 18*a*, which displays at least three lights 11 corresponding to the standard red, yellow and green lights of a traffic signal device. However, this is not meant to be limiting, as additional lights (i.e., green and yellow turn arrow lights) may additionally be included, depending on the complexity of the programming of the signal device 10.

Additionally, in keeping with the instant invention, the signal device head 18 may include a single face 18*a*, or may be chosen to include multiple faces 18*a* located on multiple sides of the signal device 10. In the most preferred embodiment, the signal device head 18 includes four faces disposed orthogonally on the four sides of a rectangular head 18, each face including at least three signal device lights 11 (i.e., a total of 12 light modules per head 18). Each of the signal device lights 11 will be covered by a lens assembly, which may additionally be injection molded. In one particular embodiment, the lenses of the lights 11 are 8 inches in diameter. Further, in a preferred embodiment of the instant invention, the signal device lights 11 will use light emitting diodes (LEDs) as the lighting source. Using LEDs will minimize the power consumption. Each light 10 can additionally be formed as an individual, self-contained light module including the circuit board, LEDs and lens and having a connector on the backside (i.e., opposite the lens-side). Such light modules can be easily snapped into and out of holes through the faces 18*a* of the signal device head 18, such that a single light can be easily replaced by simply replacing the entire light module, thus contributing to the easy maintenance of the signal device 10. The connectors of each light module connect with a mating connector inside the signal device head 18, and are both powered and controlled by a controller located within the signal device 10.

It is most preferred that the modular traffic signal device 10 be powered through a combination of battery and solar power. More particularly, solar panels 22 affixed to a solar charging portion 20 of each modular traffic signal device will be used to charge a rechargeable battery/batteries located within that traffic signal device 10, and the battery, in turn, is used to power the circuitry and lights for the traffic signal device, as will be described below. Such rechargeable battery/batteries is/are integrated into the signal device to maximize the portability and exchangeability of the signal device 10. For example, a large rechargeable battery may be stored in the hollow base 12 of the signal device 10, either in the base portion 12*b* and/or within the trunk 12*c*. As stated above, the life of the battery/batteries will be extended by being recharged, using a solar recharging system. As such, the signal device 10 will include the solar charging portion 20 (see particularly FIGS. 1 and 2A) affixed to the signal device 10. In the embodiment shown, the solar portion 20 is affixed to the top of the signal device 10 in a flat panel. However, this is not meant to be limiting, as the solar portion 20 can be affixed to any portion of the signal device 10 and/or inclined to any angle. Having an integrated solar panel will recharge the batteries, thus extending the amount of time between required maintenance visits to the signal device 10.

Alternatively, the modular traffic signal device may be powered solely by a battery, by power lines tapping into the local power grid, or by some other means, such as a gasoline generator providing AC power to the traffic signal device. However, in keeping with the modularity of the invention, the use of a battery, is preferred, with a battery combined with solar panels being most preferred, to increase the portability of the modular traffic signal device.

The signal device 10 is designed to be modular and simple to operate, thus permitting set-up by anyone with very little training or instruction. The traffic signal device 10 will be controlled by a simple solid state embedded system or circuit board, including the programming to operate the signal device 10 according to a limited number of preset programs.

Figure 3A:
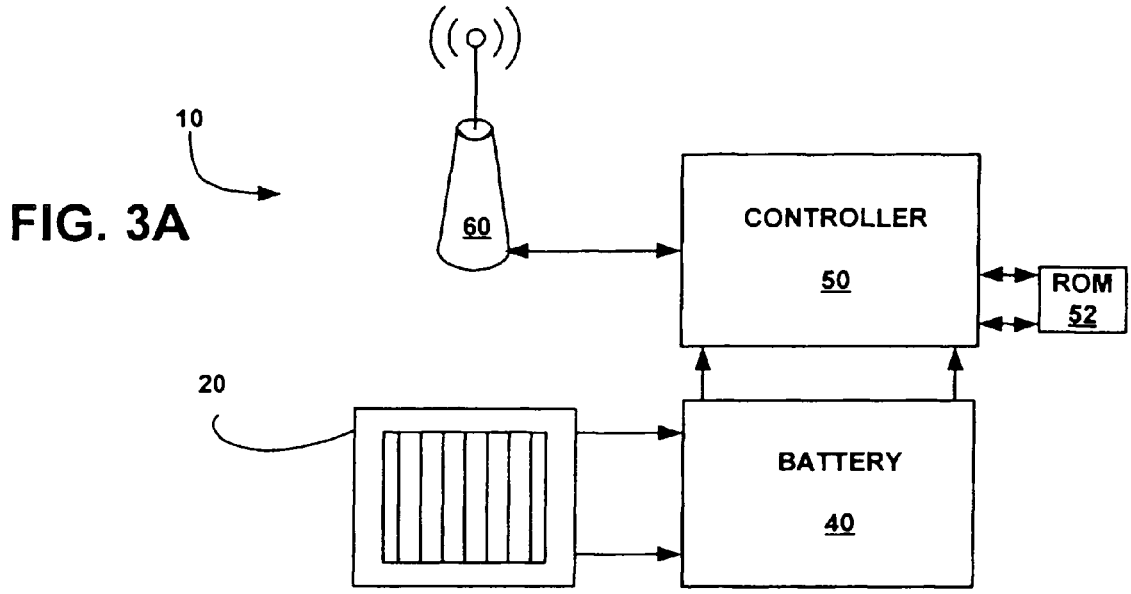
FIG. 3A is a block diagram of the circuit for use in a modular traffic signal device in accordance with one particular embodiment of the present invention.
Figure 3B:
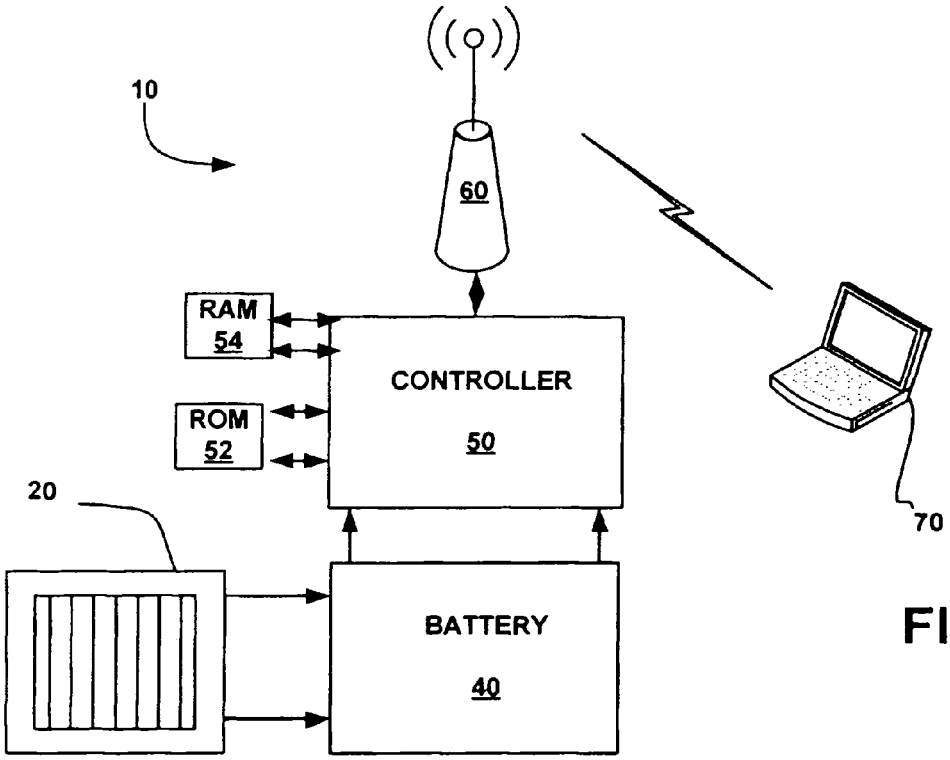
FIG. 3B is a block diagram of the circuit and external interface for programming a modular traffic signal device in accordance with one particular embodiment of the present invention.
Figure 4:
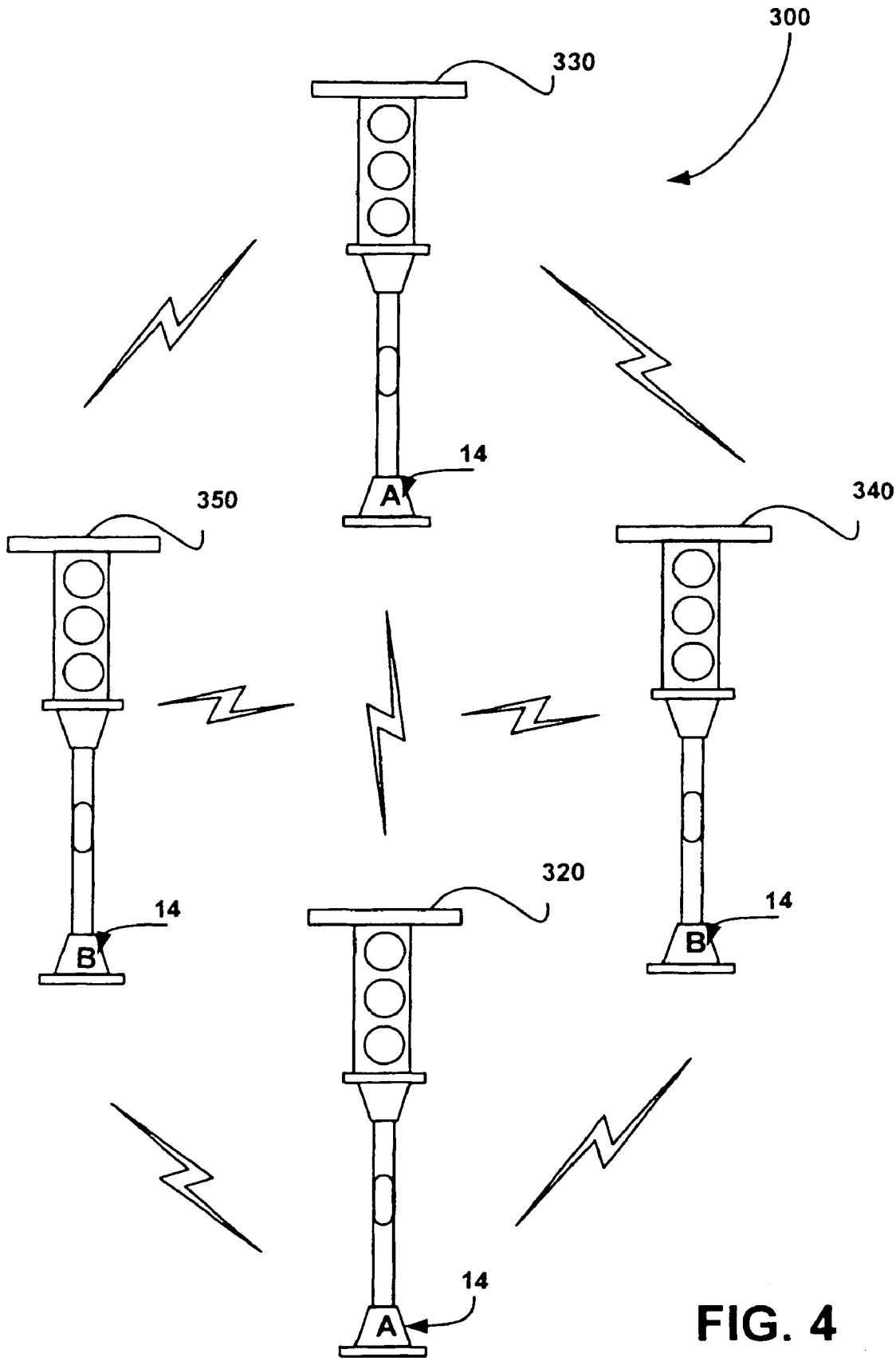
FIG. 4 is an exemplary diagram of a system in accordance with one particular embodiment of the present invention, including multiple traffic signal devices of the present invention.

As shown more particularly in FIGS. 3A-3B, the signal device 10 is controlled by a controller 50, which controller preferably includes a processor (such as a microprocessor or microcontroller), programming stored in memory (i.e., either internal memory or, optionally, in ROM 52 and/or RAM 54) and other circuitry, all encapsulated into a modular unit and affixed inside the base 12 and/or signal device head 18 of the signal device 10. As further shown in FIGS. 3A and 3B, the signal device 10 can include the solar recharging system 20 including the solar panel 22, which converts light into power and uses it to charge the battery 40. The battery 40, in turn, connects to and is used to power the controller 50. In the most preferred embodiment, the controller 50 includes and/or is connected to a transceiver 60, the operation of which will be described more fully herebelow. Transceiver 60 can be used to bidirectionally communicate between signal devices, as shown in FIG. 4 and/or with other wireless devices, as shown in FIG. 3B. Transceiver 60 can utilize any desired wireless communication technology that is compatible with the presently disclosed invention. Such wireless communication technology includes WIFI, BLUETOOTH and other established and future wireless systems. Note that the transceivers of the devices can be chosen to selectively broadcast and/or receive only local (i.e., within 100 feet or so) signals, so as to not be influenced by temporary lights in more distant intersections.

Alternatively, the casings for the traffic signal devices may be made to have a certain color or other designator to indicate that those devices are part of a group. For example, in such an embodiment, the traffic signal devices in a single intersection would be color coordinated (i.e., all the same color) or share some other designation, while the traffic signal devices in any adjacent or nearby intersections would be of a different common color or designation. The traffic signal devices of a like color or designation would then share a common communication frequency that is dissimilar to the frequency of devices having another color or designation. As such, devices of a like color or designation will communicate with each other and will not interfere with devices having a different color or designation. In this way, adjacent intersections can be set up with portable traffic signal devices in accordance with the present invention, without worrying that the communications from lights in one intersection will influence or interfere with the control of lights in another intersection. The number of such colors or designations and their associated unique frequencies can be chosen so as to ensure that any given color or designation is not repeated in an intersection within a predefined radius, so as to prevent interference with like colored/designated traffic signal devices.

Note that, in a less preferred embodiment, wherein the controller 50 is completely self-sufficient (i.e., does not receive communications from outside), the transceiver 60 may be omitted.

Referring now to FIGS. 3A, 3B and 7A-7E, the controller 50 will be described in more detail. More particularly, in one particular embodiment of the instant invention, the controller 50 of the traffic signal device 10, 210, 320-350 will, preferably, use a simple solid-state embedded control system. The controller 50 of this embodiment will include five state controller chips (i.e., five chips, each controlling a different state). Additionally, the controller will include a chip for the operating system and control and another chip for control of the wireless network. The controller can include a computer card or embedded system type design upon which the chips are mounted, to optimize interchangeability, reliability and upgradeability.

The controller will change from one state to another to control the signal process. The five states controlled by the chips are shown in Table 1 and illustrated in FIG. 7, below. Note that for purposes of explanation, the directions east, west, north and south are used. These directions apply either to the direction a light is facing on a single signal device, such as 210 of FIG. 5, or on the face facing traffic, as shown in the device 320-350 of FIG. 6.

TABLE 1

Figure 7A:
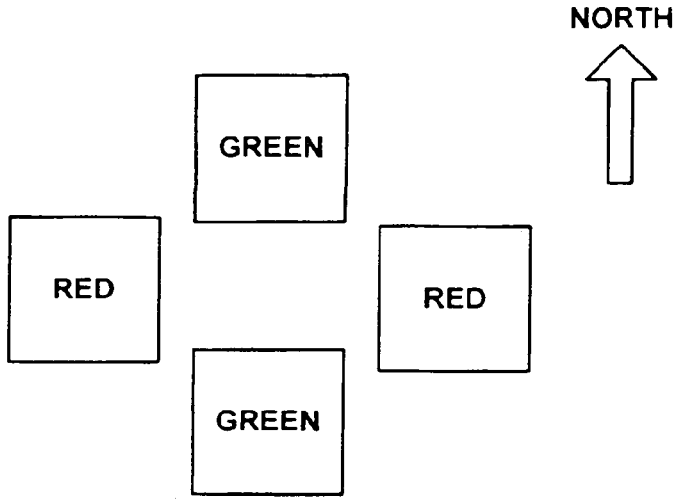
FIGS. 7A-7E are representative diagrams of five possible states to which the controller can set the lights, in accordance with a particular embodiment of the instant invention.
Figure 7B:
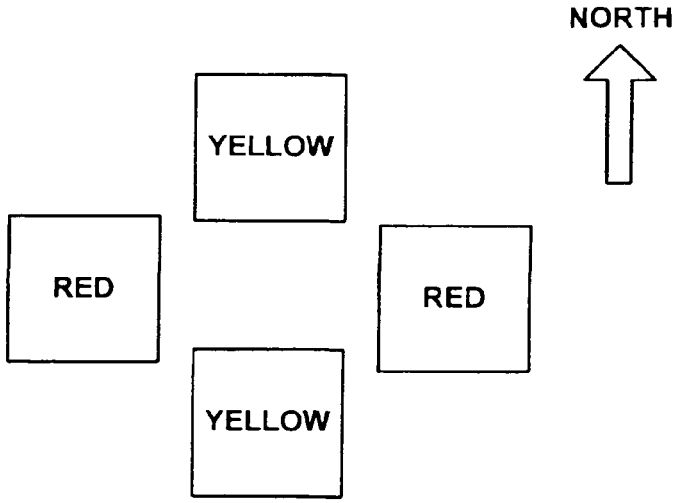
Figure 7C:
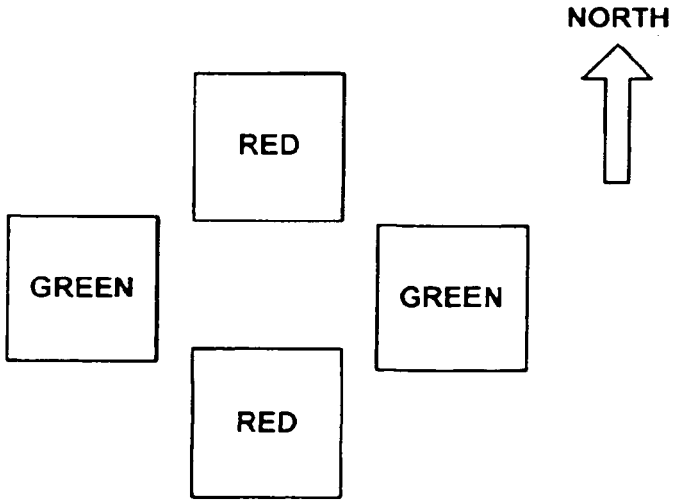
Figure 7D:
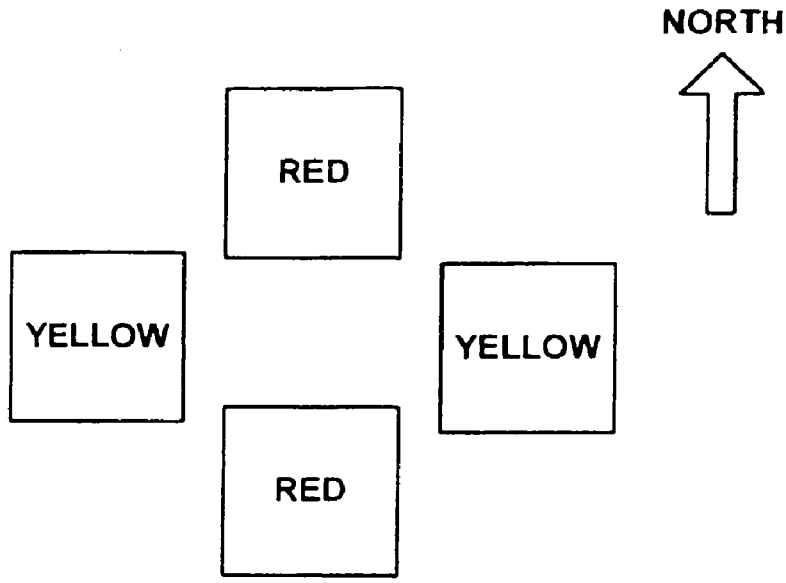
Figure 7E:
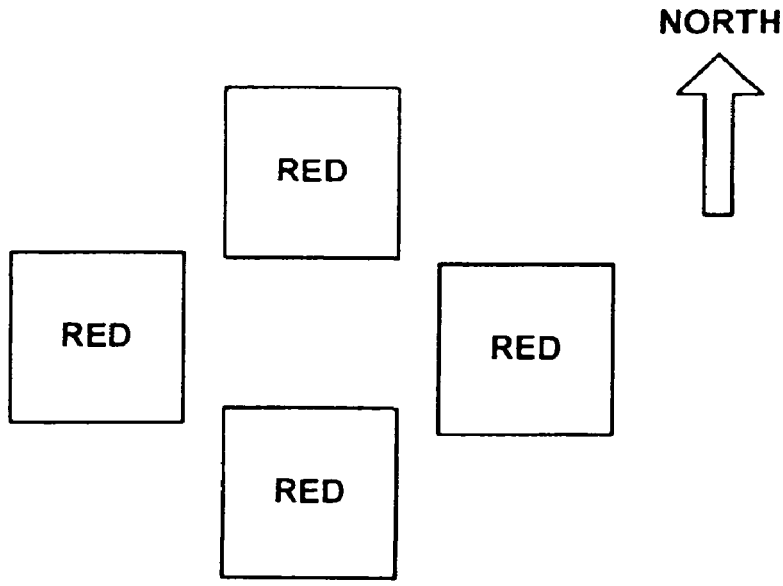

| | EAST | WEST | NORTH | SOUTH |
|---|---|---|---|---|
| STATE ONE; FIG. 7A | RED | RED | GREEN | GREEN |
| STATE TWO; FIG. 7B | RED | RED | YELLOW | YELLOW |
| STATE THREE; FIG. 7C | GREEN | GREEN | RED | RED |
| STATE FOUR; FIG. 7D | YELLOW | YELLOW | RED | RED |
| STATE FIVE; FIG. 7E | FLASHING RED | FLASHING RED | FLASHING RED | FLASHING RED |

Note that State Five illustrates a cautionary state wherein at least one signal controller has detected or experienced a problem, and all lights are flashing red for indicating caution.

The control chip of the controller 50 will provide the control for the system and activate the state chips to control the connected light modules in a number of ways, in accordance with the selected programs and the control chip operating system. The selected control functionality of the controller 50 includes:

a. providing basic time control for activation of the state chips. For example, in one particular embodiment: operating for two minutes in state 1; operating for 30 seconds in state 4; operating for two minutes in state 2; etc.

b. controlling operation of the state chips based on a predetermined schedule. This will permit scheduled changes in traffic flow. For example, the controller can be programmed to adjust the time periods in each state so as to allow for greater traffic flow into and out of the business areas during morning and evening rush hours, respectively. The controller schedule could also incorporate adjustments for weekends, school hours, special events, and other expected traffic events Additionally, utilizing the device of FIGS. 3A and 3B, the control system for each traffic device can be wirelessly enabled, to permit:

a. real time feed back to be provided to a centralized controller or controlling program;

b. multiple units to communicate with each other allowing them to work in sequence. For instance two or more units could be used in unison to control a four, eight or ten lane interchange; and c. in the case of FIG. 3B, updating the schedule and timing from any number of presently available or future devices such as a laptop computer, a personal digital assistant (PDA) type device and/or traffic control base station.

If desired, the controller 50 could also use an on-board traffic flow meter or sensor to detect traffic flow and adjust the timing of the system accordingly. A small radar type device, much like an electronic door sensor, could be used to count the number of vehicles passing in each direction. Additionally, the controller could be programmed to produce and average traffic flow in any or all directions.

Figure 5:
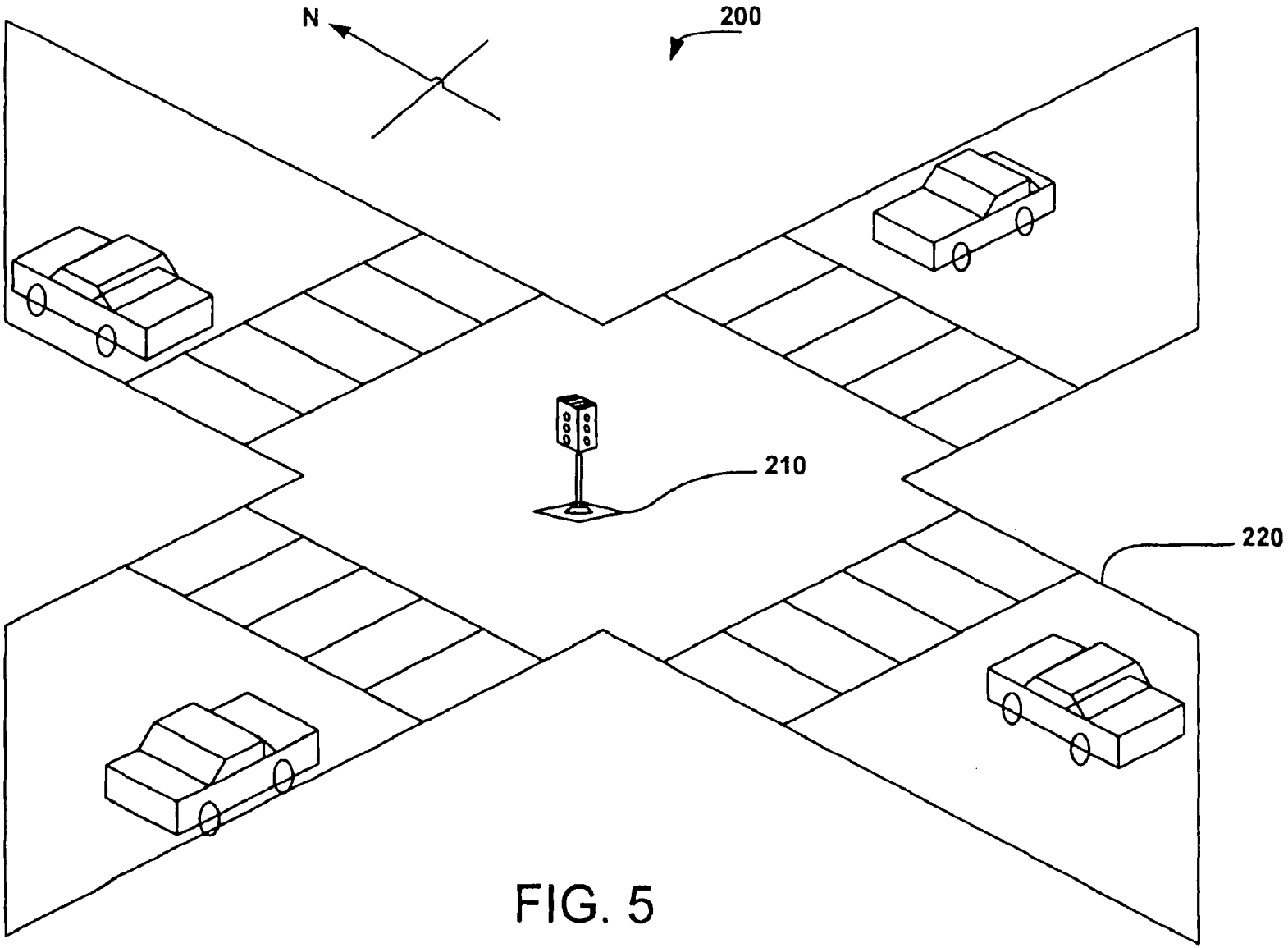
FIG. 5 is an illustration of an intersection including a modular traffic signal device in accordance with one embodiment of the instant invention.

By utilizing one of the circuits of FIGS. 3A and 3B, the same traffic signal device 10 can be used interchangeably as the sole signal device 210 in a single traffic signal device system, as shown in FIG. 5, or as each of the devices 320-350 of a multiple signal device system, as shown in FIG. 5.

Referring now to FIGS. 1-6, there will be described more particularly, certain preferred embodiments of the instant invention and the systems in which they are used.

Referring now to FIGS. 1, 3A and 5, there is shown a first, most simplified system 200 in which a signal device in accordance with the present invention, such as signal device 10, can be used. In FIG. 5, the signal device 210 has been placed in the center of an intersection 220 to control traffic from four directions. As such, the signal device 210 includes four faces (18*a* of FIG. 1) orthogonally located around the signal device head. The controller 50 is programmed to synchronistically permit traffic flow in a north-south or east-west direction, but not both. As such, the controller is programmed very simply to utilize the green, yellow and red lights in a standard way, so as to permit normal traffic flow.

In its simplest form, the modular traffic signal device 10 can be manufactured as a self-contained traffic control system for placement in an intersection, as shown in FIG. 5. A single preset program is enacted by the controller to operate the lights on the different faces (18*a* of FIG. 1) to control traffic flow. Additionally, in its simplest form the traffic signal device 10 of FIG. 1 can be manufactured as a completely self-standing unit, omitting the opening through the base 12, and thus, the door 13. Optionally, the transceiver 60 can be omitted if only a single signal device 10 is to be used. Ideally, inclusion of the transceiver 60 in every modular traffic signal device 10 manufactured permits the signal device(s) to be used interchangeably in single signal device and multiple signal device systems, as will be described more fully below. More particularly, in a preferred embodiment, even when used as the sole signal device in an intersection (i.e., a single signal device system) the modular traffic signal device 10 includes a transceiver 60, with which to communicate with other modular traffic signal devices 10 and the programming to run multiple programs. As such, although the modular traffic signal device 10 of the single signal device system embodiment is shown as being used alone, the same device can, preferably, be interchanged into a multiple signal device system.

However, in such an embodiment having only a single controller program, the signal device 210 need only have an off-state and an on-state. A switch may be provided in the base (12 of FIG. 1) or elsewhere in order to turn the signal device on and initialize the signal device 210 into its single program. Alternatively, the signal device may include a totally encapsulated, buried position switch, such that vertical placement of the traffic signal device 210 closes the switch and initializes and starts the controller program. Transporting and storing the signal device in the near-horizontal position maintains the signal device 210 and controller (50 of FIG. 3) off, until the signal device 210 is erected in its desired upright position.

As such, it can be seen how such a signal device 210 can be easily constructed and programmed (i.e., at the time of creation) as a pre-fabricated unit that merely needs to be transported to a desired position and affixed to the location, in order to resume controlled traffic flow through an intersection. As can be seen, the above described system is the ultimate in time and cost savings for establishing temporary traffic systems and controlled traffic flow after an emergency or other situation that effectively removes the traffic signal device(s) from an intersection. In addition to others, genuine savings can be achieved with such a system by reducing or eliminating the labor cost involved with posting a police officer in the intersection to direct traffic. Additionally, when the lights are working, consumers/citizens reduce the amount of lost work time due to longer travel caused by stopping at each intersection (i.e., a four way stop).

In a slightly more complex system, referring back to FIGS. 1, 3B and 5, the controller 50 can be programmed from outside the signal device 10, using a wireless device 70, such as a wireless controller, laptop PC, PDA or cell phone. The controller 50 can even be programmed by another traffic signal device, if desired. The program received externally via the transceiver 60 can be stored in the RAM 54 (i.e., if such RAM has been provided). RAM 54 can be implemented using standard RAM, flash RAM and/or other types of writable memory. The program stored in the RAM 54 can be used to supplement or override the program stored in the memory of the controller 50 or in ROM 52. Additionally, the wireless device 70 can be used to wirelessly select and enable one of a plurality of programs pre-stored in the device. This provides several advantages, including: preventing unauthorized programming of the controller through a physical controller interface panel; and selecting the program in multiple signal devices simultaneously.

Note that, if a transceiver 60 is used instead of merely a receiver, the controller 50 can be programmed to transmit an acknowledgement back to the wireless programming device 70, if the programming has been successfully loaded and received, or can send a request for retransmission if the programming has been unsuccessfully captured.

Note that, in order to provide adequate security for the traffic signal device programming, and to prevent persons from interfering with the programming of the traffic signal devices 10, 210, 320-350, the controller 50 may require receipt of a recognized signature from the wireless device 70, before writing the new program to the RAM 54. Additionally, communications between the signal device 10, 210, 320-350 and wireless device 70 may be encrypted, as known in the art. As such, the controller 50 may further include encryption and decryption circuitry.

Further, in any embodiment of the instant invention, the signal device 10 of FIG. 1, can optionally include a controller interface panel, constructed as part of the controller module. More particularly, referring now to FIGS. 1 and 2B, there is shown one exemplary form of a controller interface panel 30 which can be used with the signal device 10, 210, 320-350 of the instant invention. As shown in FIG. 1, the signal device 10 can be formed including an opening in the base 12 in order to provide access internally to the base 12. The opening in the base 12 may be selectively rendered inaccessible by the closing of a door 13 and the locking of a lock mechanism 13*a*.

Opening the door 13 gives access to the controller interface panel 30. Controller interface panel 30 is part of the module that forms the controller for the signal device. Connector 36 connects the controller to the solar recharging system, while connector 34 connects the controller to the rechargeable battery. Further, the solar recharging system may additionally or alternatively be connected directly to the rechargeable battery. Note that it is desired that the signal device controller (50 of FIGS. 3A and 3B) be an encapsulated or potted module to facilitate it being easily changed out, in the event of a malfunction. The controller interface panel 30, if included in the signal device, would be part of the interchangeable signal device controller module.

Referring back to FIG. 2B, there is shown one particular example of a controller interface panel 30. Controller interface panel 30 includes a power switch 32 for selectively turning on the signal device 10, 210, 320-350 and the controller (50 of FIGS. 3A and 3B). Alternatively, a position switch may be provided to connect the controller to power when the signal device 10, 210, 320-350 is oriented vertically, as described above. Additionally, switches 30*b* may be provided for selecting a program of operation for the traffic signal device 10, 210, 320-350. The controller (50 of FIGS. 3A and 3B) may be pre-set with a plurality of different programs, each corresponding to a button on the controller interface panel 30. Including a plurality of programs in the controller provides flexibility for using the same modular traffic signal device in a variety of different intersections. For example, program 1 may be selected if the signal device 10, 210, 320-350 is to be placed in an intersection that includes heavy east-west traffic, as well as, heavy north-south traffic, the program being selected to give equal time for traffic flow in each direction. In this example, program 2 may be selected if the signal device 10, 210, 320-350 is to be placed in an intersection where the east-west road is a main road, but the north-south route is a side road experiencing only light traffic. Thus, program 2 which provides more green light time to the east-west route, and less green light time for the north-south traffic route, may be selected. It can be seen how other programs can be set and selected to optimize traffic flow in a particular intersection. Use of a directional indicator (i.e., such as 14 of FIG. 1) on at least one side of the signal device 10, 210, 320-350 aids in the orientation of the signal device 10, 210, 320-350 for optimizing its use with a selected program. For example, in the example above wherein the program 2 favors east-west traffic, the indicator 14 can be used to affirmatively align the signal device with its first side in either the east or west direction, in order to take advantage of the program.

Upon selection, the switch buttons 30*b* may be lighted to better indicate the selected program. Alternatively, the program may be selected utilizing DIP switches and/or jumpers to ensure enactment of the selected program. Once a program has been selected the door 13 may be reclosed and the latch 13*a* be relocked, in order to prevent access to the controller panel to unauthorized individuals.

Figure 2B:
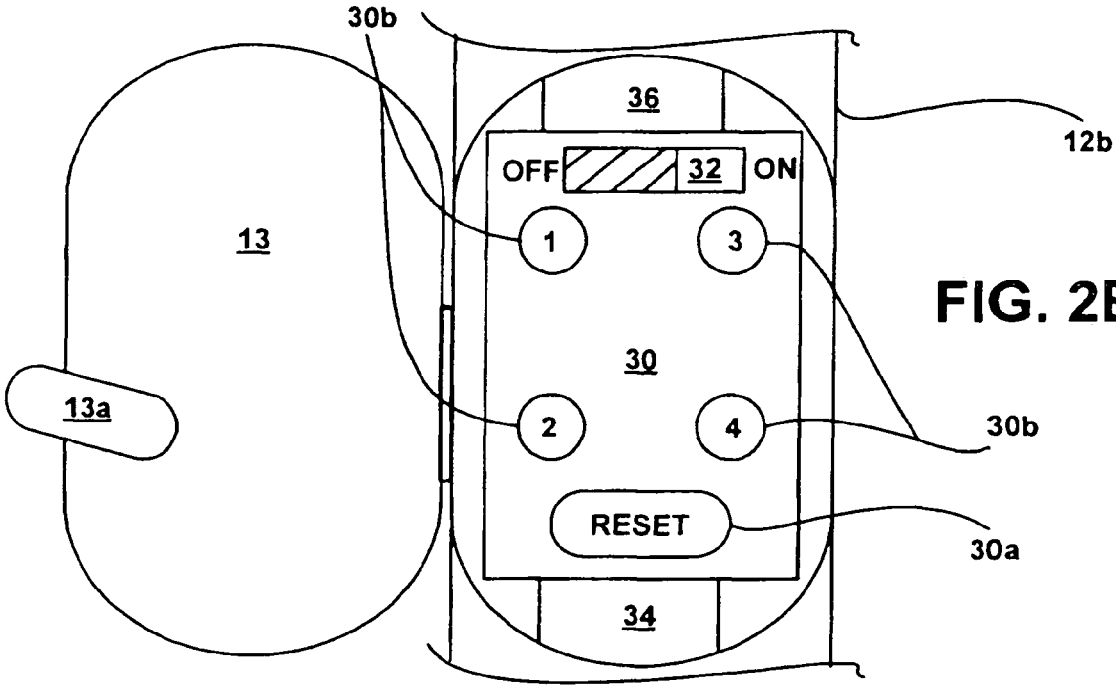
FIG. 2B is a partial enlarged view of a portion of the signal device of FIG. 1, showing an exemplary controller user interface in accordance with one particular embodiment of the present invention.
Figure 2C:
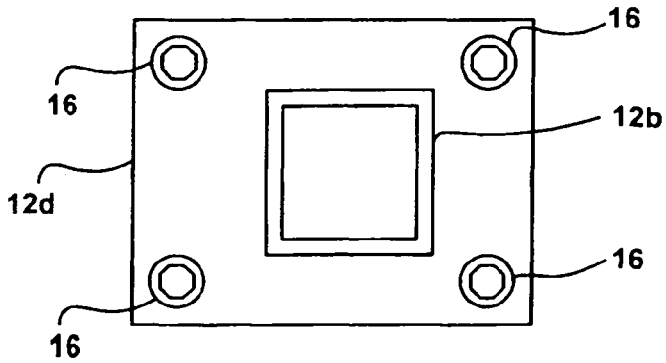
FIG. 2C is a top down perspective view of the flange portion of one particular embodiment of the present invention, viewed from the cut 2C of FIG. 1.

A signal device 10, 210, 320-350 including the controller interface panel 30 of FIG. 2B can be selected to include the circuitry of FIG. 3A or FIG. 3B. As such, if desired, a signal device including a controller interface panel 30 may additionally receive a program from an external source, as described in connection with FIG. 3B.

Further, utilizing the circuitry of FIGS. 3A and 3D, the modular traffic signal devices can be networked together, to improve safety in an intersection. Referring to FIGS. 3A, 3B, 4 and 6, it can be seen how multiple signal devices 320, 330, 340, 350, each configured similarly or identically to signal device 10 of FIG. 1, can be networked together to safely control traffic through an intersection 310.

More particularly, each of the traffic signal devices 320-350 in the system 300 includes a transceiver 60, with which it can wirelessly communicate with the remaining traffic signal devices. Most preferably, the traffic signal devices 320-350, via their transceivers 60, form a local point-to-point (P2P) network, with each traffic signal device 320-350 acting as a node on that local P2P network. In this local network, one of the traffic signal devices 320-350 acts as a master device or server to "talk" to the other client or slave devices 320-350, on the network. In the present preferred embodiment, the master/server device is used to synchronize its timer and the timers of the other devices on the network. However, unlike an atomic clock situation, wherein a master device merely broadcasts a clock signal, without any response from other devices, the present invention includes two-way communication between each of the traffic signal devices 320-350 on the network, including between the client devices and the server device.

As will be described more particularly below, in a preferred embodiment of the present invention, the server has the primary function of synchronizing the timers and receiving feedback from the clients as to whether the timers are functioning properly and are "in sync". If the timers of more than two of the traffic signal devices 320-350 are not "in sync", or are otherwise not functioning properly, as indicated by the feedback to the server, the traffic signal device acting as the server will send a signal to the traffic signal devices acting as clients to switch to the default flashing mode. Additionally, if the client devices do not receive a signal from the server device (i.e., the server device is malfunctioning), after a predetermined period of time without a signal and/or a predetermined number of missed signals, the client devices of the present embodiment will switch to the default, flashing mode.

In the present preferred embodiment, timer synchronization is the primary function of the communication on the network formed by the traffic signal devices 320-350. However, this is not meant to be limiting, as other information can also be communicated through this network, such as, for example, information relating to additional indicators operated by the traffic signal devices (i.e., a left or right turn signal, cross-walk signage, etc.), traffic data, video or other information and/or other data.

Referring back to FIGS. 3A, 3B, 4 and 6, in order to initiate operation of the system, each traffic signal device is set up at its desired location in the intersection. In setting up the devices 320-340, a person takes note of the indicator 340 (14 of FIG. 1) located on the traffic signal device. In one particular example shown in FIG. 4, all of the devices are marked on their first and/or third faces with a first indicator, such as the letter "A", and are marked on their second and/or fourth faces with a second indicator, such as the letter "B". In orienting the traffic signal devices 320-350 in a four-way intersection, such as is shown in FIG. 6, the first face of the devices 320 and 330, as denoted by the indicator "A", faces the direction of the cars entering the intersection and traveling in the direction of vector A.

However, in orienting the system 300, the second faces of the devices 340 and 350, denoted by the indicator "B", face the direction of the cars entering the intersection and traveling in the direction of vector B. In this way, traffic traveling in directions perpendicular to one another do not both receive a green light at the same time. The controller 50 will cause a green or yellow light to display on the faces "A" while a red light is on the faces "B", and vice-versa. As such, the indicators 14 are related to the program of the controller 50 and enable safe and easy set-up of the system 300. As stated above, other types of indicator (i.e., numbers, colors, words, etc.) can be used in place of or in addition to the letters shown in FIGS. 1 and 4. Further, the circuits of controllers 50 of FIGS. 3A and 3B can include a compass, GPS or other triangulating device to determine the orientation of the signal device in the intersection, and set the program accordingly (i.e., feed a position input to the controller 50 in order to determine which state is appropriate for each signal device).

Figure 6:
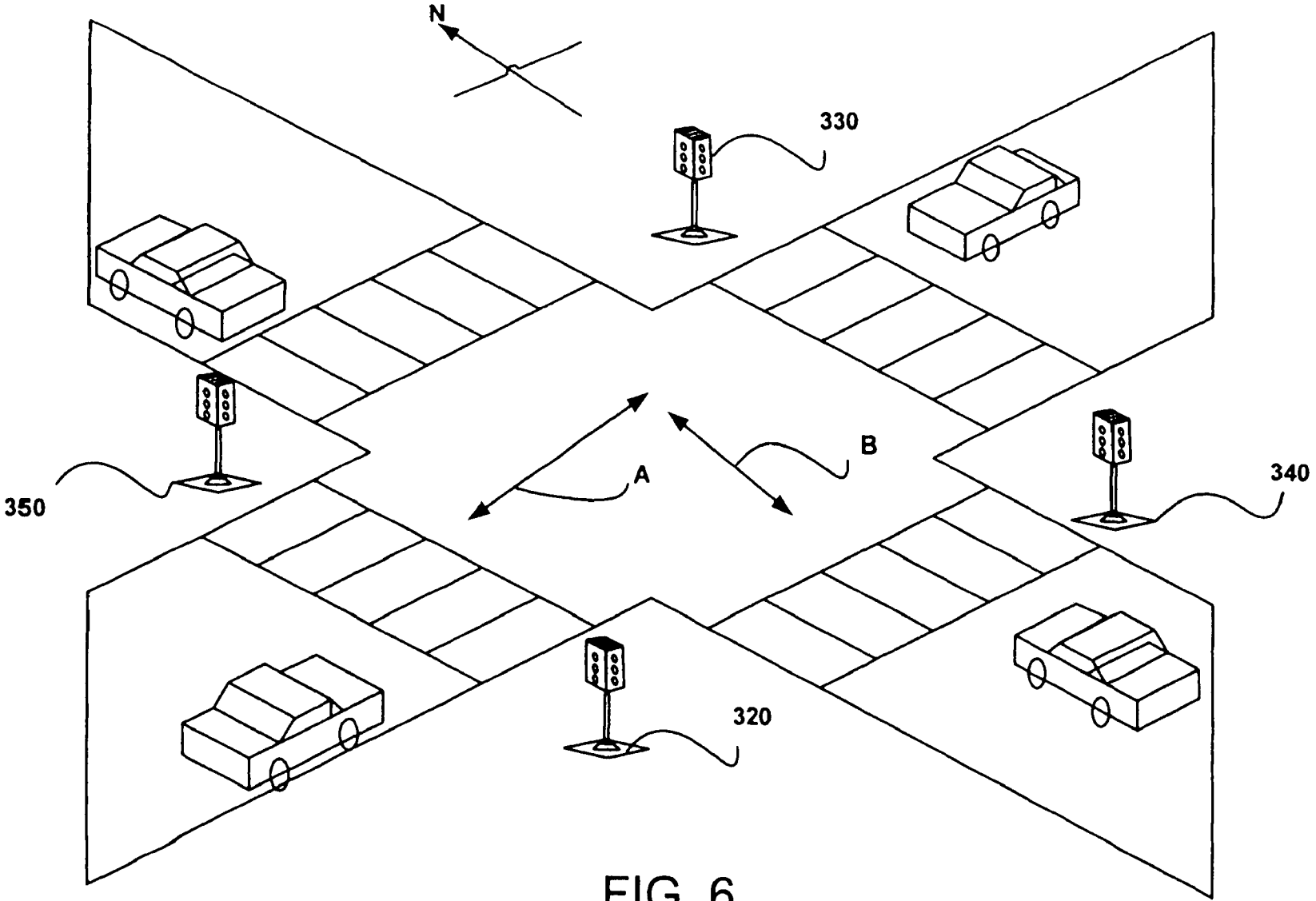
FIG. 6 is an illustration of an intersection including a plurality of networked modular traffic signal devices in accordance with another embodiment of the instant invention.

Note that, although four signal devices are shown in FIG. 6, a fifth device may be provided in the middle of the intersection, as shown in FIG. 5, in addition to the traffic signal devices 320-350. Such a signal would be oriented to align the matching indicators with those of the other signal devices.

Each signal device 320-350, once placed, can be secured to its location using a fastener and/or adhesive, as described above. Further, each traffic signal is initiated for operation by one of the following methods:

1. Turning on the signal device, which initiates its sole program;
2. Selecting and/or downloading a program of a controller operation using a wireless device to enable an existing program; or
3. Physically selecting a program of controller operation on a controller interface panel.

Once each signal device 320-350 has been located, the program of operation can begin.

Figure 8:
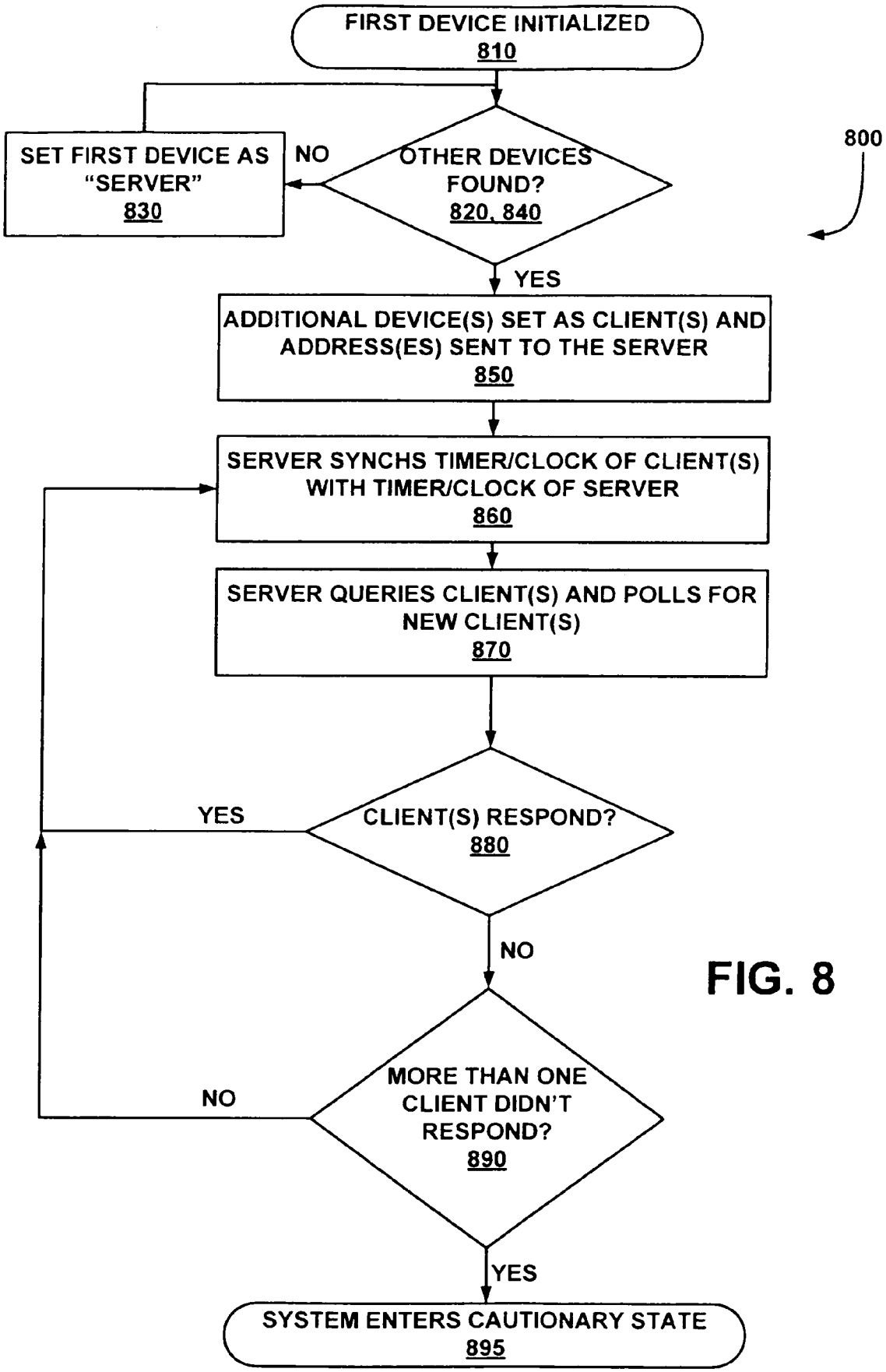
FIG. 8 is a flow diagram of one particular method of using a system, in accordance with one particular embodiment of the present invention.

Referring now to FIG. 8, there will be described one method of networked operation 800 of the system 300, in accordance with one particular embodiment of the instant invention. A first signal device is located and initialized, selecting a program in accordance with those stored in its memory. Step 810. Once on, the first device wirelessly attempts to locate (i.e., polls for) other devices with which to communicate. Step 820. If the device does not find another device, the signal device establishes itself as the server or "master" device, and enters its program of operation, as though it were the only device in the intersection. Step 830. Periodically, the server device wirelessly polls for (or queries) other devices. Step 840. Once a second device has been turned on, either it is located by the server device, or it locates the server device, itself. Upon establishing contact with the server device, the second device designates itself as a client device or "slave" and sends its address to the server device. Step 850. Such address can be configured similarly to a device address in the BLUTOOTH protocol, as a TCIP address in a WIFI system, or as another type of unique address that identifies the signal device. Such address can be fixed or can be spontaneously created, as with certain IP addresses.

As each signal device is enabled, communication is established with the server device and the client device provides the server device with its address. In the system of FIG. 6, the server device establishes contact with three client devices, thus representing a local network having four nodes (i.e., one for each of traffic signal devices 320-350). Each client device has been initialized and started by selecting the same program that was selected at the server device when the server device was started. Thus, all nodes on the network (i.e., all of the traffic signal devices 320-350) are running the same program.

However, in the preferred embodiment of the instant application, each controller includes its own timer or clock that is used by the controller 50 of each particular traffic signal device to precisely change the traffic light states, in accordance with the selected program running in each particular traffic signal device. As such, the particular sequence of lights for each traffic signal device is independently controlled (i.e., locally to each traffic signal device) in order to switch the states of the traffic lights in accordance with the programming in that particular traffic signal device, and based on that traffic signal device's own internal timer or clock.

Because the signal devices were turned on at different times, the timer or clock of any one signal device 320-350 is potentially out of synch with the timers or clocks of the other devices 320-350. As such, one of the functions of the server device is to synchronize the timers/clocks of each of the client devices to the timer of the server device. Such timer can be a clock, or alternately, can be a countdown timer, based upon the expiration of which the pre-set program of the signal device is consulted for a next state operation. Unless otherwise specified, the terms "timer" and "clock" will be used interchangeably herein.

Upon establishing communication with a client device, the server device synchronizes the timer of that client device with its own timer. Step 860. Periodically thereafter, the server device polls the address of (i.e., pings) each client device to determine that the client device is still functioning correctly and to re-synchronize the client device timers with that of the server. Step 870. The timers of the client devices can be synched by the server device individually, using the device's particular address, or simultaneously, through a globally addressed signal.

Note that, as stated previously, the server device of the instant invention does not directly signal the change of state of any of the client devices. Rather, the server device only directly synchronizes the timers of each client signal device. Each client device then acts according to its own internal selected program to locally set the state of its lights. In one preferred embodiment, the timers are synchronized at least once a day. In a more preferred embodiment, the timers are synchronized at least once an hour. In an even more preferred embodiment, the timers are synchronized at least once a minute. In another preferred embodiment, the master timer synchronizes the timer of each slave device several times per minute. In a most preferred embodiment the master timer synchronizes the timer of each slave device at least once per second.

As stated above, if the server polls the address of a client device, and that client device does not respond or otherwise indicates a problem, the server makes a note of the defect. Step 880. Upon noting a defect, depending on the programming, the server may continue operation as before, or may cause all of the lights to enter a cautionary state of the program. More particularly, if the server determines that something has occurred to a client traffic signal device (i.e., after a predetermined number of missed queries, which can beat least one missed query, but preferably is a plurality of missed queries), the server may cause all responsive devices on the network to enter a cautionary state (shown in FIG. 7E). One possible cautionary state would cause all of the lights to enter a state where the lights flash red, thus requiring a four way stop, at least on the remaining responsive signal devices. In one particularly preferred embodiment, the programming of the controller permits the server device to continue operation as usual even upon determining that a device has failed to respond or failed to respond properly, but the programming of the controller causes the server to initiate the caution state of operation once it has been detected that two signal devices have become defective. Steps 890 and 895. Further, in a preferred embodiment of the invention, if the client devices go more than a predetermined period without being polled, thus indicating that something has happened to the server device, programming in the controller of the client devices will cause all responsive devices on the network to enter a cautionary state.

Figure 9:
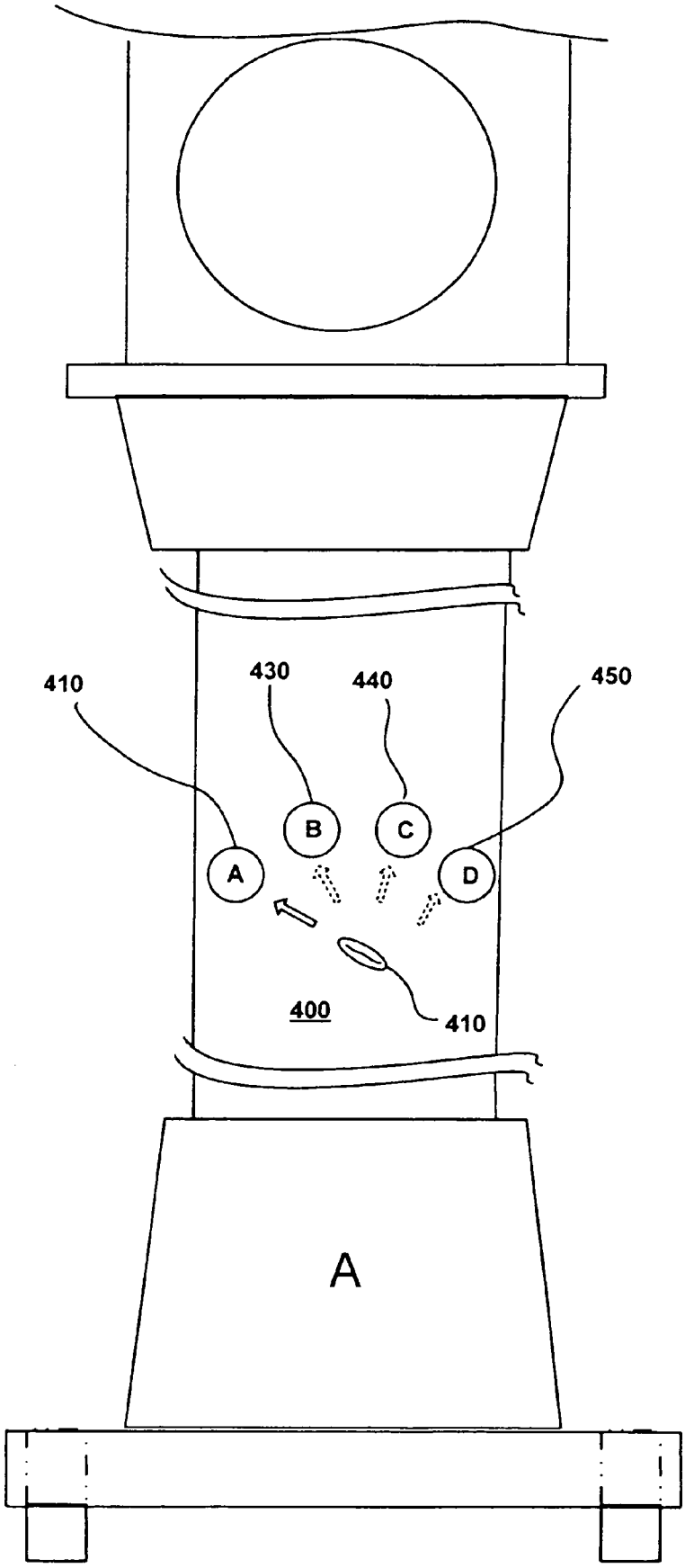
FIG. 9 is a partial view of a portion of a traffic signal device in accordance with one particular embodiment of the present invention, showing a further exemplary controller user interface.

In another preferred embodiment, in order to greatly simplify the set-up of such a traffic signal device 10, the controller interface panel can additionally be simplified. Referring now to FIG. 9, there is shown an interface panel 400 that need not be covered by a door, such as the door 13 of FIG. 2B. Rather, the different available programs are accessible and settable from the outside of the column portion of the traffic signal device 10. More particularly, using a key, each traffic signal device 10 can be set to either be a serer device in a particular program, or to be a client device running the same program as the server device. For example, inserting a key into the keyhole 410 will permit the program to be set to either position 420, 430, 440 or 450 in order to choose one of programs A, B, C or D, which can be either pre-set or uploaded programs. Once the program has been selected, the key can be removed, thus locking in the selected program. Such a system can use any type of key, although the use of a proprietary key may be desired to prevent people from tampering with the programming of the traffic signal devices.

In one particular example of the present invention, which uses the selection device of FIG. 9, the system can have three possible programs corresponding to positions 420, 430 and 440. Setting the key selector to one of the positions 420, 430 or 440 sets the selected device to be the server device and initiates the program designated by the position of the key selector. In such an example, all of the other traffic devices in the same intersection have their key selectors set to position 450, indicating to them that they are the client devices. Upon initiating two-way communication with the client devices, the server device communicates to the client devices which of the pre-stored programs (which are already present in each traffic signal device) has been selected for operation and synchronizes the timer or count clock of the client devices, in order to synchronize operation. Note that, as described above, if the server device ceases to communicate with the client devices, programming in the client devices causes the remaining responsive devices to enter a cautionary state.

Alternatively, other ways (i.e., including those described otherwise herein) can be used to define and/or maintain the server/client relationship between a plurality of traffic signal devices 10 in an intersection.

Note that the invention is not intended to be limited only to the above description of the preferred embodiments. Rather, the implementation of the invention can deviate from the above description, while still being in the spirit of the present invention. For example, instead of being supported by poles affixed to the ground, modular traffic signal devices in the form of traffic signal device heads may be hung from the existing infrastructure in an intersection. Such self-sustained traffic heads may be formed, for example, through injection molding, and may include the control circuitry, battery and/or solar recharging system and/or light modules described above.

As can be seen from the foregoing, the modular design of the traffic signal device of the instant invention allows for ease of assembly, maintenance and transportation. Further, the modularity of Applicants' inventive design will permit damage to one signal device to be repaired by combining parts from other damaged traffic signal devices, in order to create a whole working traffic signal device. Using a single piece for the main portion of the exterior housing (i.e., the base and/or signal device head) will also aid in the assembly of the traffic signal devices. Only a completely destroyed part could not be used in the repair and maintenance of another unit. The simplicity in design also allows for little need for training, if any, in the maintenance or placement of the unit.

We claim:

1. A traffic signal system, comprising:

a first traffic signal device, including a first communications device and a first plurality of lights;

a second traffic signal device, including a second communications device and a second plurality of lights;

said first traffic signal device running a first program for controlling said first plurality of lights in a particular sequence based on a first clock defined in said first traffic signal device;

said second traffic signal device running a second program for controlling said second plurality of lights in a particular sequence based on a second clock defined in said second traffic signal device;

said first traffic signal device communicating with said second traffic signal device to synchronize said second clock with said first clock; and said second traffic signal device periodically communicating information back to said first traffic signal device.

2. The traffic signal system of claim 1, wherein said first traffic signal device periodically communicates with said second traffic signal device to periodically synchronize said second clock with said first clock.

3. The traffic signal system of claim 2, wherein said first traffic signal device communicates with said second traffic signal device at least once per minute in order to periodically synchronize said second clock with said first clock.

4. The traffic signal system of claim 2, wherein said first traffic signal device provides additionally communicates information to said second traffic signal device choosing said second program.

5. The traffic signal system of claim 2, wherein said first traffic signal device operates as a server device and said second traffic signal device operates as a client device.

6. The traffic signal system of claim 2, wherein said first program is chosen from a plurality of possible programs stored in said first traffic signal device and said second program is chosen from a plurality of possible programs stored in said second traffic signal device.

7. The traffic signal system of claim 6, wherein said first program and said second program are chosen to be the same program.

8. The traffic signal system of claim 6, wherein at least one of said first program and said second program is stored in at least one of said first traffic signal device and said second traffic signal device by communicating with an external device, prior to running said at least one of said first program and said second program.

9. The traffic signal system of claim 6, wherein at least one of said first program and said second program is selected using a physical key.

10. The traffic signal system of claim 2, wherein said first traffic signal device periodically queries said second traffic signal device.

11. The traffic signal system of claim 10, wherein said first traffic signal device periodically requests a network identity of said second traffic signal device.

12. The traffic signal system of claim 10, wherein, if said second traffic signal device fails to respond to a query by said first traffic signal device, said first traffic signal device causes the traffic signal system to enter a cautionary state.

13. The traffic signal system of claim 10, wherein, if said first traffic signal device fails to query said second traffic signal device after a predetermined period of time, said second traffic signal device causes the traffic signal system to enter a cautionary state.

14. The traffic signal system of claim 2, further including:

at least a third traffic signal device, including a third communications device and a third plurality of lights;

said third traffic signal device running a third program for controlling said third plurality of lights in a particular sequence based on a third clock defined in said first traffic signal device;

said first traffic signal device additionally communicating with said third traffic signal device to synchronize said third clock with said first clock.

15. The traffic signal system of claim 14, wherein said first traffic signal device, said second traffic signal device and said third traffic signal are part of a local area network.

16. The traffic signal system of claim 15, wherein said first traffic signal device acts as a server device and said second traffic signal and said third traffic signal act as client devices.

17. The traffic signal system of claim 16, wherein said server device informs said client devices of the program to be run in said client devices.

18. The traffic signal system of claim 15, wherein said first traffic signal device periodically queries said second and third traffic signal devices.

19. The traffic signal system of claim 18, wherein, if said first traffic signal device fails to query said second traffic signal device or said third traffic signal device for a predetermined period of time, one of said second traffic signal device and said third traffic signal device causes the traffic signal system to enter a cautionary state.

20. The traffic signal system of claim 18, wherein, if at least two of said traffic signal devices fail to respond to said query, said first device causes the traffic signal system to enter a cautionary state.

21. The traffic signal system of claim 2, wherein said first traffic signal and said second traffic signal are portable.

22. The traffic signal system of claim 21, wherein said first traffic signal and said second traffic signal include a solar power source.

23. A traffic signal system, comprising:

a first traffic signal device, including a first communications device and a first plurality of lights;

a second traffic signal device, including a second communications device and a second plurality of lights;

said first traffic signal device running a first program for controlling said first plurality of lights in a particular sequence;

said second traffic signal device running a second program for controlling said second plurality of lights in a particular sequence;

said first traffic signal device and said second traffic device being part of a network;

each of said first traffic signal device and said second traffic signal device being assigned a unique network address;

said first traffic signal device periodically querying said second traffic signal device using said second traffic signal device's unique network address;

at least a third traffic signal device, including a third communications device and a third plurality of lights, said third traffic signal device additionally being assigned a unique network address;

said first traffic signal device additionally periodically querying said at least a third traffic signal device using its unique network address; and said first traffic signal device causing the traffic signal system to enter a cautionary state if at least two traffic signal devices on the network fail to respond to a query.

24. The traffic signal system of claim 23, wherein said first traffic signal device, said second traffic signal device and said at least a third traffic signal device are portable.

25. The traffic signal system of claim 23, wherein said first traffic signal device, said second traffic signal device and said at least a third traffic signal device include a solar power source.

26. A method of setting up a temporary traffic signal system, comprising:

initializing a first traffic signal device by selecting a first program of operation of the first traffic signal device, the first program of operation running according to a first clock in the first traffic signal device;

initializing at least a second traffic signal device in communication with the first traffic signal device, the at least a second traffic signal device running a second program of operation according to a second clock in the second traffic signal device;

with the first traffic signal device, periodically synchronizing the first clock with the second clock; and periodically communicating information from the second traffic signal device to the first traffic signal device.

27. The method of claim 26, wherein the second program of operation is chosen based on information communicated from the first traffic signal device to the at least a second traffic signal device.

28. The method of claim 26, including the steps of:

periodically querying the at least a second traffic signal device with the first traffic signal device; and setting the system to a cautionary state if the first traffic signal device fails to query the at least a second traffic signal device after a predetermined time period.

29. The method of claim 28, including the step of:

setting the system to a cautionary state if the at least a second traffic signal device fails to respond to a plurality of queries from the first traffic device.

30. The method of claim 26, including the steps of:

initializing a third traffic signal device in communication with at least the first traffic signal device, the third traffic signal device running a third program of operation according to a third clock in the third traffic signal device;

initializing at least a fourth traffic signal device in communication with at least the first traffic signal device, the at least a fourth traffic signal device running a fourth program of operation according to a fourth clock in the fourth traffic signal device;

periodically querying the at least a second traffic signal device, the third traffic signal device and the at least a fourth traffic signal device with the first traffic signal device; and setting the system to a cautionary state if at least two traffic signal devices fail to respond to a predetermined number of queries.

31. The method of claim 26, wherein bodies of the first traffic signal device and the at least a second traffic signal device are formed as unitary structures of injection molded plastic.

32. The method of claim 31, wherein the first program is run by a first modular controller and the second program is run by a second modular controller, the first modular controller being interchangeable with the second modular controller.

33. The traffic signal system of claim 1, wherein said first traffic signal receives information from a GPS satellite.

34. The traffic signal system of claim 23, wherein the timing of a first clock is set using a signal received from a source external to said network.

35. The traffic signal system of claim 34, wherein at least one of said first traffic signal device and said second traffic signal device receives information from a satellite.

36. The traffic signal system of claim 35, wherein said satellite is part of the GPS network.

37. The method of claim 26, further including the step of setting the timing of the first clock using a signal received from a source external to the temporary traffic signal system.

* * * * *